US007390401B2

(12) United States Patent
Hodak

(10) Patent No.: US 7,390,401 B2
(45) **Date of Patent: *Jun. 24, 2008**

(54) POOL SKIMMER SEAL ASSEMBLY

(75) Inventor: Jerry Hodak, 155 Zehner School Rd., Zelienople, PA (US) 16063

(73) Assignees: Jerry Hodak, Zelienople, PA (US); Linda Hodak, Zelienople, PA (US)

( * ) Notice: Subject to any disclaimer, the term of this patent is extended or adjusted under 35 U.S.C. 154(b) by 144 days.

This patent is subject to a terminal disclaimer.

(21) Appl. No.: 11/346,483

(22) Filed: Feb. 2, 2006

(65) Prior Publication Data

US 2006/0124521 A1 Jun. 15, 2006

Related U.S. Application Data

(63) Continuation-in-part of application No. 10/693,478, filed on Oct. 23, 2003, now Pat. No. 7,011,747.

(51) Int. Cl.
*E04H 4/12* (2006.01)

(52) U.S. Cl. ..... 210/167.1; 210/232; 210/416.2; 4/496

(58) Field of Classification Search ..... 210/167.1, 210/232, 167.12, 416.1, 416.2; 4/496, 507
See application file for complete search history.

(56) References Cited

U.S. PATENT DOCUMENTS

| | | | | |
|---|---|---|---|---|
| 2,244,316 | A * | 6/1941 | Robertson | 215/262 |
| 3,239,149 | A | 3/1966 | Lindberg, Jr. | |
| 3,445,973 | A | 5/1969 | Stone | |
| 3,508,661 | A | 4/1970 | Diemond et al. | |
| 3,733,621 | A | 5/1973 | Jannuzzi, Jr. | |
| 3,900,130 | A | 8/1975 | Andrews | |
| 4,126,925 | A | 11/1978 | Jacuzzi | |
| 4,368,550 | A | 1/1983 | Stevens | |
| 4,735,714 | A | 4/1988 | Schall | |
| 4,819,681 | A | 4/1989 | Hodak | |
| 4,843,658 | A | 7/1989 | Hodak | |
| 4,903,351 | A | 2/1990 | Dengel et al. | |
| 4,913,810 | A | 4/1990 | Hodak | |
| 5,040,250 | A | 8/1991 | Barnes et al. | |
| 5,194,162 | A | 3/1993 | Hodak | |
| 5,285,538 | A | 2/1994 | Hodak | |
| 5,388,567 | A | 2/1995 | Hodak | |
| 5,604,939 | A | 2/1997 | Widener | |
| 5,937,453 | A | 8/1999 | Hodak et al. | |
| 5,948,245 | A | 9/1999 | Hodak | |
| 6,226,938 | B1 | 5/2001 | Hodak | |
| 6,578,208 | B1 * | 6/2003 | Lytle | 4/507 |
| 6,701,542 | B2 | 3/2004 | Marbach | |
| 2006/0260035 | A1 * | 11/2006 | Baker et al. | 4/507 |

* cited by examiner

*Primary Examiner*—Fred Prince
(74) *Attorney, Agent, or Firm*—Buchanan Ingersoll & Rooney PC

(57) ABSTRACT

A seal for a pool skimmer is provided. The seal is attached to the inner periphery of the faceplate via cooperating male/female connectors on the seal and inner periphery of the faceplate at the opening for fluid passage from the pool to the skimmer housing and filter assembly. In this manner, the surface of the seal is generally flush with the faceplate. Moreover, the fasteners which secure the faceplate and the skimmer housing to the pool sidewall remain accessible for later adjustment by the pool owner or pool service personnel with the seal securely in place. The seal may include a ring tab or other member extending from the outer periphery thereof for ease of removal of the seal.

21 Claims, 6 Drawing Sheets

POOL SKIMMER SEAL ASSEMBLY

CROSS-REFERENCE TO RELATED APPLICATIONS

This application is a continuation-in-part of patent application Ser. No. 10/693,478 entitled "Pool Skimmer Assembly" filed Oct. 23, 2003, now U.S. Pat. No. 7,011,747 the entire disclosure of which is incorporated by reference herein.

FIELD OF THE INVENTION

The present invention is directed toward a pool skimmer assembly and, more particularly, toward a faceplate seal for sealing an opening of a skimmer apparatus.

BACKGROUND OF THE INVENTION

In recreational pools, such as swimming pools, spas or whirlpools, it is typical to use a pool cleaning apparatus that employs a skimmer. The skimmer housing is mounted to an outside surface of the sidewall of the pool and includes a filter means for cleaning the water within the pool after it is drawn through the skimmer. A faceplate is mounted to the inside surface of the pool and has a generally large opening that is sealed with respect to the inside surface of the pool wall and is generally located at the surface water level. The skimmer includes means for creating a vacuum within the housing so that the surface water continuously flows from the pool surface into the housing and then through the pool filtering equipment and then back into the pool by means of another opening or outlet port generally located below the surface level of the water.

The skimmer housing assembly is mounted behind the pool wall and the faceplate is fastened to the opposite surface of the pool wall, such as by screws that pass through the faceplate and the pool wall, and is threaded into the skimmer housing assembly. A gasket may be positioned between the faceplate and the pool wall for an additional watertight seal. In this manner, a seal is provided between the faceplate, the pool wall, and the skimmer housing.

During initial construction of the skimmer assembly, it is not uncommon for the screws that mount the faceplate to the pool to become loose a short time after initial installation. Periodically, the owner of the pool must retighten these fasteners in order to maintain the seal and to prevent leakage of water behind the skimmer faceplate and housing. Typically, this retightening procedure must occur during the winter months in the North, for example, when the pool has been covered-over for the winter months. Moreover, in order to prevent water from freezing within the skimmer assembly and damaging the typically plastic components due to expansion of the ice within the skimmer, the skimmer assembly must be evacuated to prevent the build-up of ice within the skimmer. Additionally, within many pools, it is important to maintain the level of water within the pool so as to provide support for the walls of an in-ground pool, for example.

In order to close off the opening of the skimmer, closure assemblies have been developed to cover the faceplate prior to the evacuation of water from the skimmer so that the level of water within the pool remains generally consistent with the level of the faceplate. However, the re-tightening procedure necessitates the owner removing the cover from the pool and accessing the screws around the outer periphery of the skimmer faceplate. Examples of such closure assemblies are shown in U.S. Pat. Nos. 4,913,810, 5,285,538 and 5,937,453. However, if the pool owner needs to retighten the screws around the faceplate, for example, if a leak occurs between the faceplate and pool wall, these cover assemblies need to be removed in order to access the screws. Since these cover assemblies fit over the faceplates, and hence over the screws, it is necessary to remove the faceplate to access the screws. This then allows water to flow into the skimmer assembly during the cold winter months and requires re-evacuation of the skimmer.

What is needed, then, is a pool skimmer faceplate cover that completely seals off the skimmer, while allowing access to the screws for retightening by the pool owner.

The present invention is directed toward overcoming one or more of the above-mentioned problems.

SUMMARY OF THE INVENTION

In order to overcome these problems associated with the prior art, the pool skimmer assembly of the present invention is provided. In accordance with the above and other objects and advantages of the present invention, a pool skimmer assembly, for a pool having a sidewall with an opening therein, comprises a skimmer housing adapted to be mounted to an outside surface of the sidewall adjacent the pool opening so as to be in fluid communication with the pool. A faceplate is secured to an inside surface of the sidewall adjacent the skimmer opening, the faceplate further including an outer periphery and an inner periphery, the inner periphery being in fluid communication with the pool opening and the skimmer housing and including a male/female connector thereon. A means for fastening the faceplate to the sidewall is provided such that the faceplate is sealingly secured to the inside surface of the sidewall. A skimmer seal having a female/male connector which sealingly engages the male/female connector on the inner periphery of the faceplate, whereby the skimmer housing is not in fluid communication with the pool. The seal may include a ring tab or other member extending from the outer periphery thereof for ease of removal of the seal.

It is an object of the present invention to provide a pool skimmer assembly having a faceplate seal while allowing access to its fasteners.

It is another object of the present invention to provide a faceplate seal having improved sealing engagement.

Other objects, aspects, and advantages of the present invention can be obtained from a study of the specification, the drawings, and the appended claims.

BRIEF DESCRIPTION OF THE DRAWINGS

Various other objects, features and advantages of the present invention, in addition to the above, will become readily apparent to those skilled in the art, by reading the following detailed description in conjunction with the drawings, which are shown by way of example only, wherein.

DETAILED DESCRIPTION OF THE INVENTION

Figure 1:
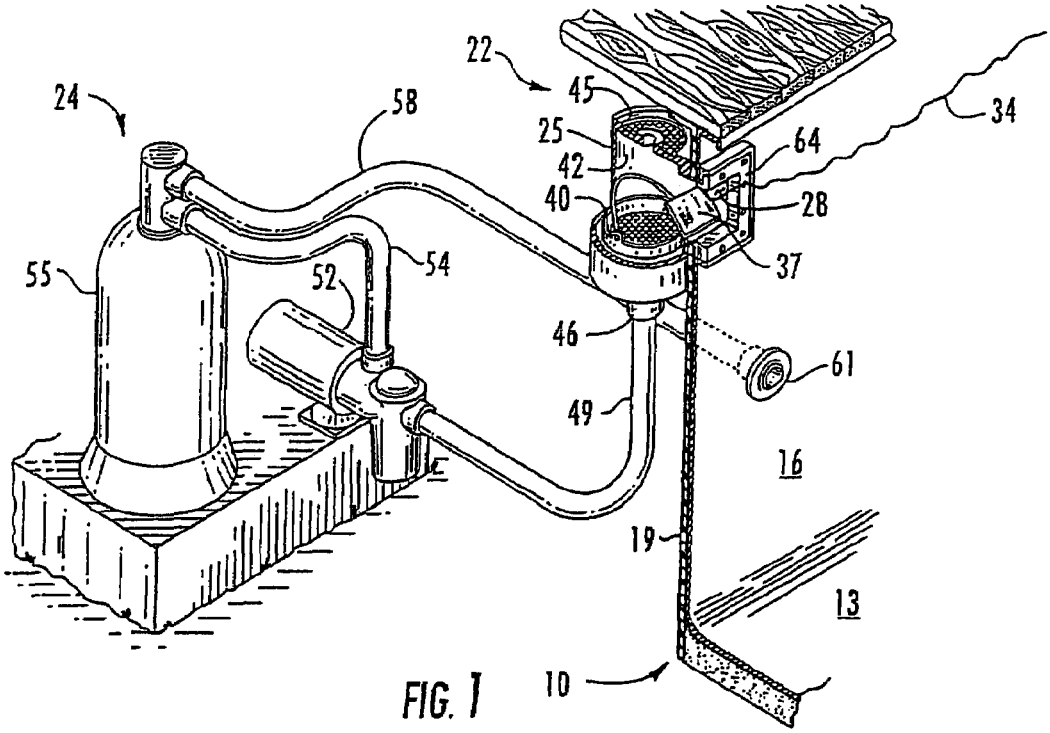
FIG. 1 is a perspective view of a skimmer apparatus operatively mounted to a swimming pool, in accordance with the present invention.
Figure 2:
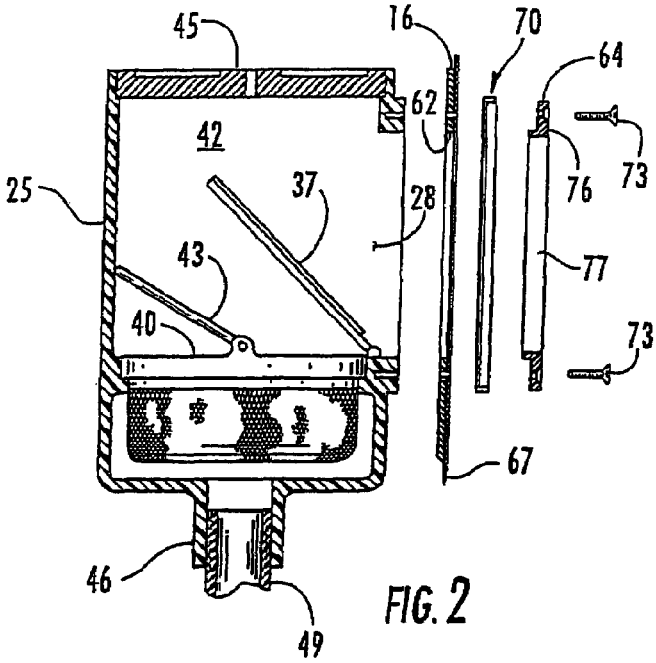
FIG. 2 is a perspective exploded view of a skimmer apparatus; shown in FIG. 1.

Referring now to the drawings in detail wherein like numerals refer to similar components within the figures, there is shown in FIG. 1 a conventional pool and skimmer assembly. Although described with respect to a recreational swimming pool 10, it will be appreciated that the skimmer assembly of the present invention could also be used with a whirlpool or spa of any shape and size. The pool includes a floor 13 and one or more sidewalls 16, depending upon the shape of the pool 10, such as oval, round, rectangular, etc. Mounted on the outside surface 19 of the sidewall 16 for the pool 10 is a skimmer assembly 22 that is operatively connected to a filter assembly 24. The filter assembly 24 can be mounted either above or below the surface level of the pool. The skimmer assembly 22 includes a housing 25 having an opening 28 in fluid communication with the water 34 in the pool 10, and may be covered by a pivotally mounted door 37 for providing access to the skimmer. A basket 40 for collecting debris within the housing collection chamber 42 has a handle 43 for periodic removal of the basket 40 and the debris by removing the housing lid 45. The skimmer assembly 22 has an outlet 46 that is connected to the filter assembly 24 by means of a pipe 49. The filter assembly 24 includes a pump 52 for creating a partial vacuum within the skimmer housing 25 and drawing water 34 from at or near the surface level of the pool 10 via the pump 52 and second conduit 54 into the filter unit 55 so as to clean the water. After passing through the filter unit 55, the cleaned water passes out a third conduit or pipe 58 to an inlet port 61 to return the cleaned water back to the pool 10, which port 61 is typically mounted adjacent to the skimmer assembly 22 below the surface level of the water 34.

In order to seal the opening 62 of the pool sidewall 16 at the area where the skimmer housing 25 is mounted, a faceplate 64 is mounted to the inside surface 67 of the pool wall 16 opposite the opening 28 of the skimmer housing 25. A gasket 70 may be mounted behind the faceplate 64 against the interior or inside surface 67 of the pool sidewall 16 in order to more effectively seal the opening 62 in the pool sidewall 16. The faceplate 64 is attached to the pool sidewall 16 and skimmer housing 22 by means of screws 73 or other types of fasteners that pass through the faceplate 64, optional gasket 70 and through corresponding openings within the pool sidewall 16 and into the skimmer housing 25. It will be readily appreciated that other fasteners, such as bolts and nuts, may be utilized.

Figure 3:
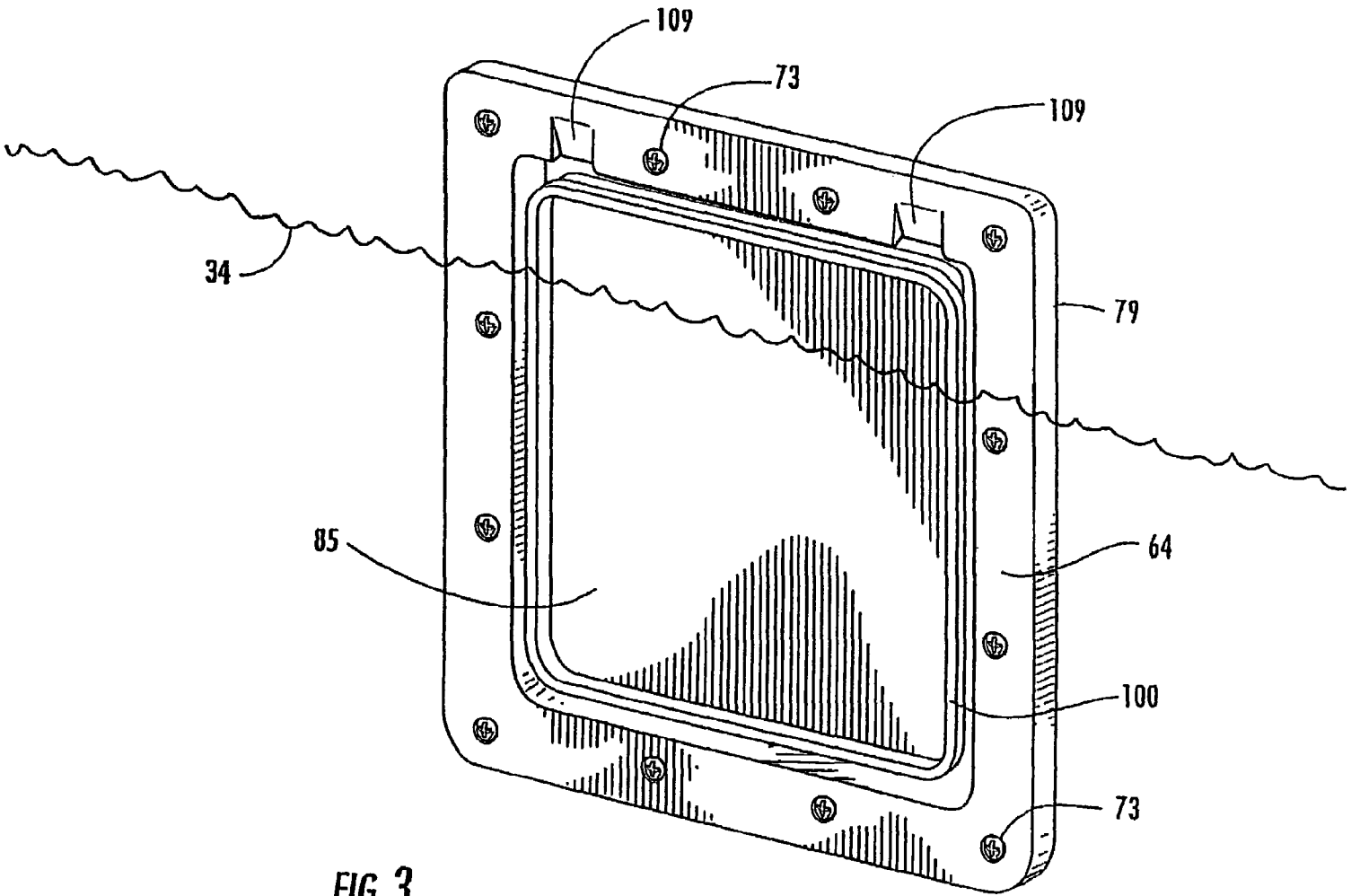
FIG. 3 is a plan view of a skimmer faceplate seal according to the teachings of the present invention.

As shown more fully in FIG. 3, the pool skimmer faceplate 64 is generally rectangular in shape, although it can be of any configuration, and projects slightly outward from the inside surface 67 of the pool sidewall 16. A plurality of screws 73 are threadingly engaged with the pool skimmer housing 25 after they pass through the corresponding openings within the faceplate 64, gasket 70 and pool sidewall 16 in order to secure the skimmer assembly 22 to the pool sidewall 16. The faceplate 64 has an inner periphery 76, defining a faceplate opening 77 for permitting passage of water 34 into the skimmer housing 25 and an outer peripheral edge 79. According to a preferred embodiment of the present invention (see FIG. 4), the inner periphery 76 of the pool skimmer faceplate 64 includes a generally C-shaped channel 82. This C-shaped configuration is adapted to engage the pool skimmer seal 85 according to the present invention.

Figure 4:
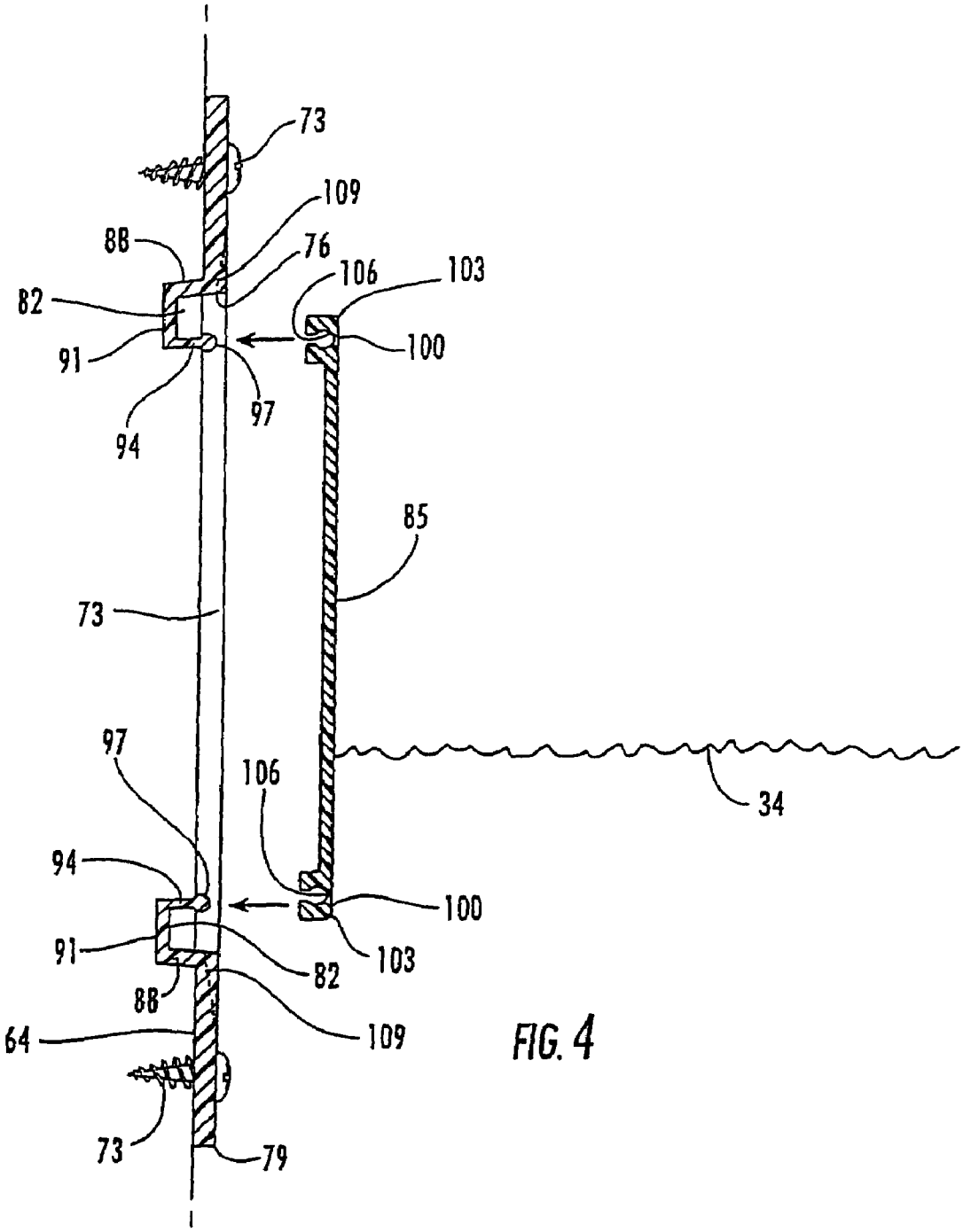
FIG. 4 is a cross-sectional side view showing the interaction of the pool skimmer seal assembly of the present invention with the faceplate shown in FIG. 3.

As shown in FIG. 4, the inner periphery 76 of the opening 77 for the faceplate 64 includes a first arm 88 which projects outward from the pool and towards the skimmer housing 25 then a second arm 91 perpendicular thereto projecting toward the opening, with a third arm 94 being perpendicular to the second arm 91 (and generally parallel to the first arm 88) and projecting back towards the interior of the pool 10. The third arm 94 also includes, preferably, a rounded portion 97 for sealingly engaging the pool skimmer seal 85 of the present invention. The pool skimmer seal 85 comprises a generally flat sealing member or lid having a complimentary C-shaped portion 100 on its outer periphery 103 to sealingly engage the C-shaped inner periphery 76 of the pool skimmer faceplate 64. The outer periphery 103 of the pool skimmer seal 85 includes a rounded opening 106 which closely matches that of the faceplate 64 rounded portion 97 so as to provide a frictional engagement between the pool skimmer seal outer edge 103 and the inner periphery 76 of the pool skimmer faceplate 64. By utilizing rounded corners rather than 90° sealing edges as used in the prior art, the two sealing areas of the faceplate and the seal create a double seal to better ensure leak protection. Also, the outer periphery rounded opening 106 provides a recess into which an o-ring lubricant can be inserted to provide additional water-tightness.

Although the preferred embodiment of the present invention is described as having a C-shaped inner periphery 76, it will be appreciated by those skilled in the art that other shapes are possible. For example, a generally L-shaped periphery can be provided, such as by eliminating the first arm 88 so that the second arm 91 comprises an arm projecting downward from the inner periphery of the faceplate and the third arm comprises another arm projecting perpendicularly therefrom. Also, the inner periphery may be more circular rather than rectangular. So long as the third arm 94 is provided, and preferably having the rounded portion 97, for engaging the outer periphery 103 of the seal 85, any configuration of the faceplate 64 inner periphery 76 is possible and can be formed using conventional plastic molding and fabrication techniques.

With each of these configurations, when attached to the faceplate 64, the seal 85 is generally flush with the surface of the faceplate. This aids in preventing accidental removal of the seal 85 from the faceplate 64 in the event of ice build-up, for example, on the surface of the water 34.

In this manner, after the pool skimmer seal 85 is in place over the pool skimmer faceplate 64 (FIG. 4), the water can be evacuated from the pool skimmer housing 25 and any additional water is prevented from entering the skimmer by the seal 85 according to the present invention. Moreover, and perhaps more importantly, the fasteners 73 that mount the faceplate 64 to the pool sidewall 16 and skimmer housing 25 remain accessible for later tightening by the pool owner while the seal 85 remains in place. Contrasting with the prior art, the pool skimmer seal 85 does not have to be removed in order to access these screws 73, obviating a generally troublesome procedure for pool owners.

In order to remove the pool skimmer seal 85, such as in the spring months when the pool owner wants to re-open the pool, the faceplate 64 may comprise one or more notched areas 109 to facilitate the pool owner or pool service personnel in removing the pool skimmer seal 85. While the notched areas 109 provide a means by where a pool owner can grab the seal 85 along its outer edge 103, it may be more convenient to use a screwdriver, or other flat-faced tool, in order to pry the pool skimmer seal 85 from the faceplate 64. Moreover, by sealing along the inner periphery 76 of the faceplate 64, the sealing area is smaller than when sealing along its outer periphery, on the order of 50% smaller. This reduction in seal length reduces the risk of leakage, amount of material needed to manufacture the seal 85, and reduces the ultimate price to the consumer.

An advantage of the present invention over the prior art is that the outer periphery 103 of the seal 85 of the present invention is "shielded" from any external forces engaging the seal 85, as is common with ice formations or other objects which may contact and remove typical seal assemblies which mount on the outer periphery 79 of the faceplate 64. Since the outer edge of the seal 85 fits within the C-shaped opening 82 of the faceplate 64, the outer peripheral edge 103 of the seal 85 is generally flush with the surface of the faceplate 64 and cannot be easily bumped by another object that may inadvertently remove the seal 85 from the faceplate 64.

If the pool owner desires to provide a cover over the screws 73 during the winter months, the outer periphery 79 of the faceplate 64 can also be provided with a lip or raised portion so that a second cover (not shown) can be placed around the outer periphery 79 of the faceplate 64. While this provides a second layer of protection to prevent water from leaking into the skimmer housing 25 when it is not desired, the pool owner may feel additional comfort that the skimmer assembly 22 is completely closed off during the winter months. Also, decorative covers can be installed over the faceplate 64 when the pool is in use to conceal and protect the skimmer hardware. However, in order to access the screws 73, the pool owner must remove the second cover, while the pool skimmer seal 85 of the present invention keeps the interior of the skimmer housing free from water while necessary maintenance is performed on the fasteners 73.

Figure 5:
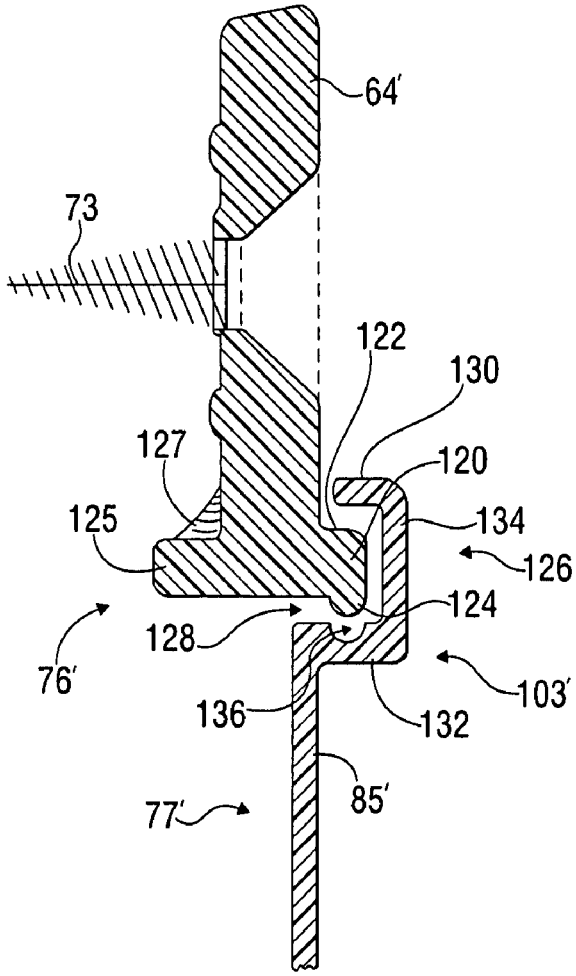
FIG. 5 is a partial cross-sectional side view of an additional embodiment of the present invention illustrating the interaction of the pool skimmer seal assembly with the faceplate.

Referring to FIG. 5, a further embodiment of attaching the pool skimmer seal 85' to the pool skimmer faceplate 64' is illustrated. As shown in FIG. 5, the inner periphery 76' of the opening 77' for the faceplate 64' includes an arm 120 projecting generally toward the interior of the pool 10 and defining a ledge 122 extending about the inner periphery 76'. The arm 120 includes an extended, or rounded, portion 124 extending generally toward the opening 77' and away from the ledge 122. The extended portion 124 defines a male connecting portion of the faceplate 64'. As shown in FIG. 5, the inner periphery 76' may also include an arm 125 extending toward the skimmer housing 25. However, the arm 125 is optional and may be omitted. The arm acts as a shield to not only hide the cut edge of the skimmer hole, or knockout on the pool wall, for placement of the skimmer housing 25, but may also include silicon 127 applied to the inside corner of the arm 125 before mounting to seal the pool wall opening and prevent chemically treated pool water from penetrating past the faceplate 64' and attacking the pool wall (which is generally made of metal). This aids in preventing the skimmer housing 25 from leaking through corrosion at the pool wall which may result in the skimmer housing 25 pulling away from the pool wall and falling off with the weight of the water in the skimmer housing 25 and/or from water wake caused by swimming.

The pool skimmer seal 85' includes a generally flat sealing member, or lid, having a complementary portion 126 on its outer periphery 103' to sealingly engage the inner periphery 76' of the pool skimmer faceplate 64'. The portion 126 is generally C-shaped having an interior 128 configured to match and fit snugly against the arm 120 of the faceplate 64', engaging the ledge 122 and extended portion 124 and providing a frictional engagement between the pool skimmer seal outer edge 103' and the inner periphery 76' of the pool skimmer faceplate 64'.

The portion 126 includes generally parallel arms 130 and 132 connected by a third arm 134, which is generally perpendicular to the arms 130 and 132. Arm 130 fits snugly against and frictionally engages the ledge 122, while arm 132 includes a recessed portion 136 which closely matches and engages the extended portion 124 of the arm 120. The recessed portion 136 acts as a female connector for securing the lid 85' to the faceplate 64'. The interior 128 surrounds the arm 120, such that the arm 130 frictionally engages the ledge 122, and the extended portion 124 is received in and frictionally engages the recessed portion 136, such that the lid 85' is frictionally secured to the faceplate 64'.

Figure 10:
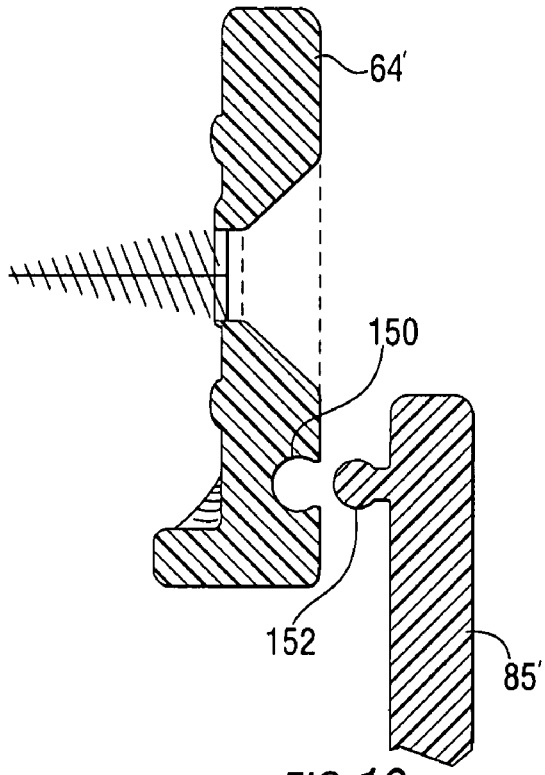
FIG. 10 is a partial cross-sectional side view of a further embodiment of the present invention illustrating the interaction of the pool skimmer seal assembly with the faceplate.
Figure 6:
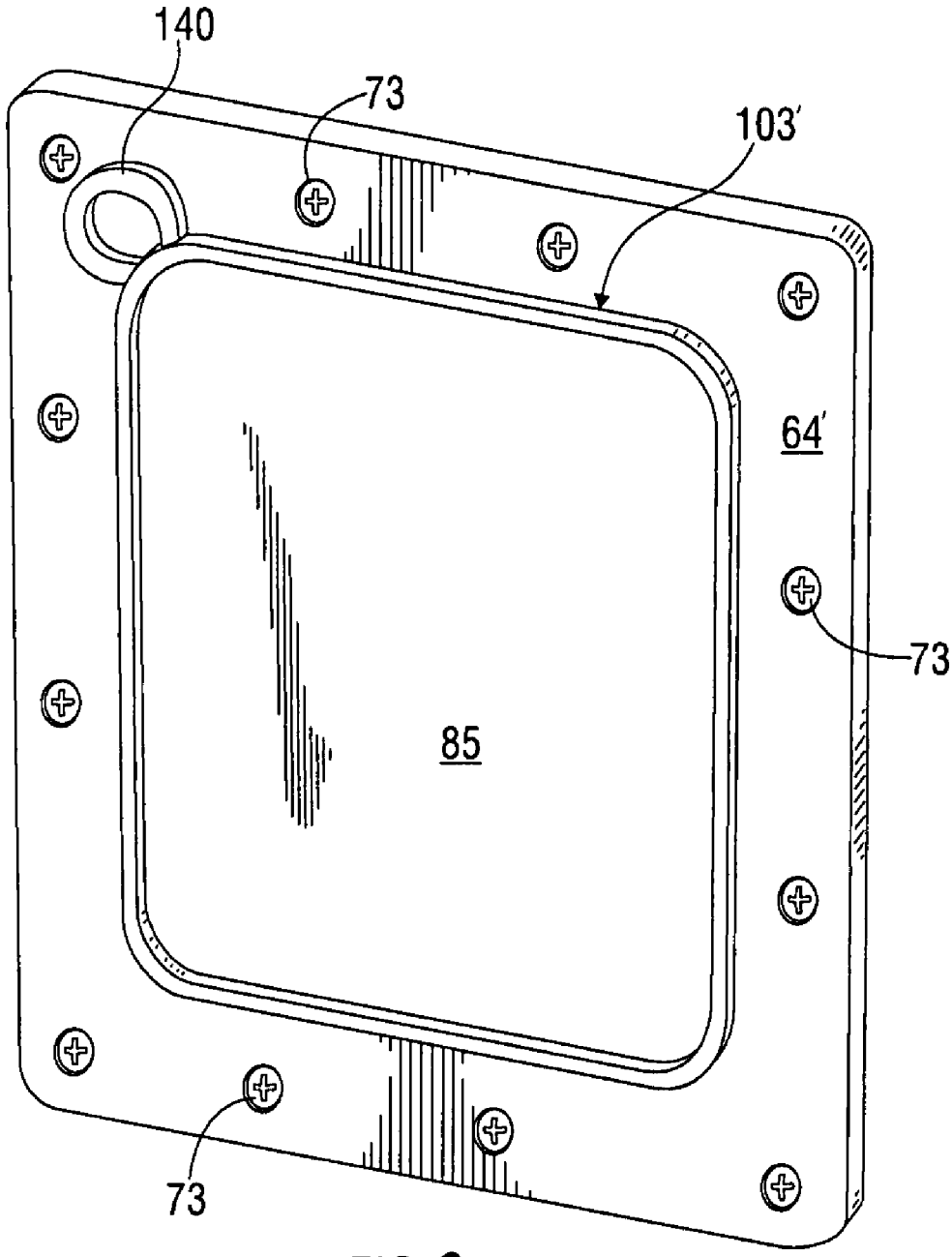
FIG. 6 is a perspective view of yet a further pool skimmer seal assembly having a ring tab extending therefrom for ease of removal.
Figure 7:
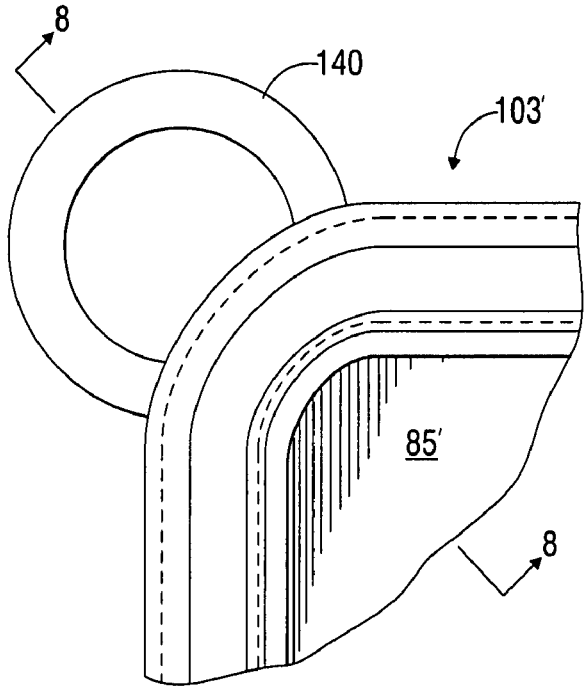
FIG. 7 is an enlarged view of a corner of the pool skimmer seal shown in FIG. 6, with the faceplate removed, and including a ring tab extending therefrom for ease of removal.

While the extended portion 124 has been described as being on the faceplate 64' and the recessed portion 136 has been described as being on the lid 85', it should be understood that the faceplate 64' may include a female connector 150 with the lid 85' including a male connector 152, in accordance with the teachings of the present invention (see FIG. 10). Additionally, the male and female connectors may be provided on the ledge 122 and arm 130, or on the arm 134 and a corresponding portion of the arm 120, again to frictionally secure the lid 85' to the faceplate 64'.

In order to facilitate easy removal of the lid 85', as shown in FIGS. 6-9, a ring tab 140 may be provided on a corner or other portion of the lid 85' extending from the outer periphery 103' thereof. The lid 85' in FIGS. 6-9 includes an optional arm 141 extending toward the skimmer housing 25, which would abut the arm 125 on the faceplate 64' with the lid 85' attached. A user may grasp the ring tab 140 and easily remove the lid 85' from the faceplate 64'. While a ring tab 140 having an opening 142 is shown in FIGS. 6-9, any type of member extending from the lid 85' may be utilized without departing from the spirit and scope of the present invention. A ring tab 140 is preferred, since a flat, solid thumb tab is generally difficult to hold onto when wet and reaching under water where algae forms on the lid and tab in early spring before the pool is opened and treated with chemicals. A solid tab design requires a good finger grip using compression of the index, or other, finger and thumb. The ring tab 140 with hole 142 provides the benefit that a user simply needs to reach under and through the ring tab with his/her index, or other, finger and pull away to remove the lid, a much easier method for people that don't have the strength in their fingers to pinch the flat tab design.

Figure 8:
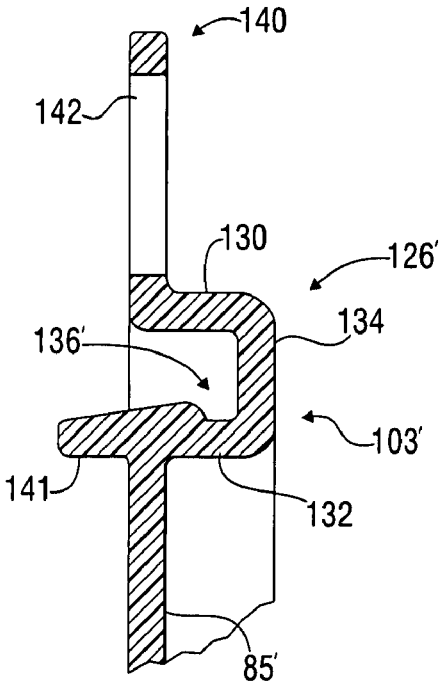
FIG. 8 is a cross-sectional view taken along line 8-8 of FIG. 7.
Figure 9:
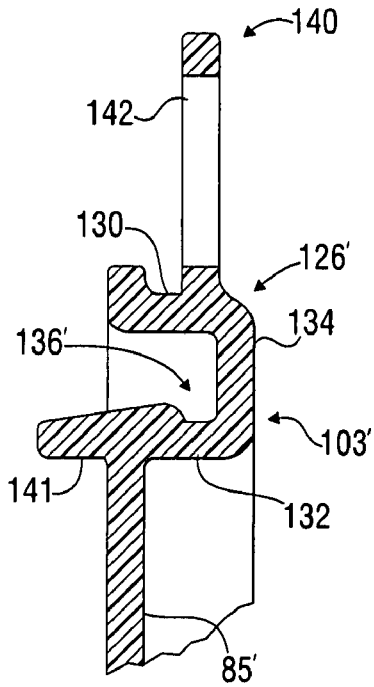
FIG. 9 is a cross-sectional view taken along line 8-8 in FIG. 7 illustrating an additional embodiment of the ring tab.

As shown in FIGS. 8-9, the ring tab 142 may be positioned at various places on the outer periphery 103' of the skimmer seal 85'. For example, as shown in FIG. 8, the ring tab 142 is positioned at the end of the arm 130, and will generally lie against the faceplace 64' when the skimmer seal is attached thereto. In an alternate form, as shown in FIG. 9, the ring tab is provided at the corner where the arms 130 and 134 meet. In this form, the ring tab is spaced from the faceplate 64' when the skimmer seal 85' is attached thereto, thus making it easier for a person to position their index, or other, finger through the ring tab 142 and remove the lid. It should be understood that the ring tab 142 may be positioned at any place along the pool skimmer seal outer edge 103' and in any orientation (parallel, perpendicular, diagonal, etc.) relative to the plane defined by the skimmer seal 85' without departing from the spirit and scope of the present invention.

It will appreciated that the cross-section of the complementary portion 126' on the pool skimmer seal outer edge 103' in FIGS. 8-9 is slightly different that that of FIG. 5, in that the recessed portion 136' is positioned closer to the arm 134 in FIGS. 8-9. The recessed portion 136' closely matches and engages a cooperating extended portion formed at the inner periphery of the faceplate in a manner similar to that described with respect to FIG. 5 to provide a frictional engagement between the pool skimmer seal outer edge 103' and the inner periphery of the pool skimmer faceplate.

While specific embodiments of the invention have been described in detail herein, it will be appreciated by those skilled in the art that various modifications and alterations may be developed in light of the overall teachings of the present invention without departing from the spirit and scope thereof. Presently, the embodiments discussed herein are meant to be illustrative only and not limiting as to the scope of the invention, which is to be given the full breadth of the appended claims and in any and all equivalents thereof.

I claim:

1. A skimmer assembly for a pool having a sidewall with an opening therein, the skimmer assembly comprising;

a skimmer housing adapted to be mounted to an outside surface of the sidewall adjacent the opening so as to be in fluid communication with the pool;

a faceplate adapted to be secured to an inside surface of the sidewall adjacent the opening, the faceplate including an outer periphery and an inner periphery, the inner periphery being in fluid communication with the opening and the skimmer housing and including a male/female connector thereon;

means for fastening the faceplate to the sidewall such that the faceplate is sealingly secured to the inside surface of the sidewall; and a skimmer seal having a female/male connector which sealingly engages the male/female connector on the inner periphery of the faceplate, whereby the skimmer housing is not in fluid communication with the pool.

2. The skimmer assembly as recited in claim 1, wherein said means for fastening comprises a plurality of screws which pan through openings in the faceplate and the sidewall and are threadingly engaged with the skimmer housing.

3. The skimmer assembly as recited in claim 1, wherein the inner periphery of the faceplate comprises an arm projecting generally toward an interior of the pool and having the male/female connector thereon.

4. The skimmer assembly as recited in claim 3, further comprising a lubricant applied between the faceplate inner periphery and the skimmer seal outer periphery.

5. The skimmer assembly as recited in claim 3, wherein the arm includes a male connector extending toward the opening.

6. The skimmer assembly as recited in claim 3, wherein the skimmer seal includes a C-shaped outer periphery which frictionally engages the arm, the C-shaped outer periphery including the female/male connector which sealingly engages the male/female connector on the inner periphery of the faceplate.

7. The skimmer assembly as recited in claim 1, wherein the skimmer seal includes a member extending from an outer periphery of the skimmer seal.

8. The skimmer assembly as recited in claim 7, wherein the member comprises a ring tab.

9. The skimmer assembly as recited in claim 1, wherein the outer periphery of the faceplate comprises a lip adapted to engage a second cover.

10. The skimmer assembly as recited in claim 1, wherein the skimmer assembly further includes a second cover attachable to the outer periphery of the faceplate.

11. A faceplate for a pool skimmer assembly, the faceplate comprising:

an outer periphery;

an inner periphery defining an opening for fluid communication between the pool and the skimmer assembly; and means for securing the faceplate to a pool sidewall, wherein the inner periphery further comprises an arm projecting generally towards an interior of the pool, wherein the arm includes means for sealingly engaging a skimmer seal such that the pool skimmer assembly housing is not in fluid communication with the pool.

12. The faceplate as recited in claim 11, wherein the sealingly engaging means comprises a male/female connector provided on the arm which frictionally engages a cooperating female/male connector provided on an outer periphery of the skimmer seal.

13. The faceplate as recited in claim 12, wherein the male/female connector comprises a rounded portion on the arm.

14. The faceplate as recited in claim 13, wherein the rounded portion extends from the arm toward the opening.

15. The faceplate as recited in claim 11, wherein the skimmer seal includes a member extending from an outer periphery of the skimmer seal.

16. The faceplate as recited in claim 15, wherein the member comprises a ring tab.

17. An assembly for sealing a pool skimmer assembly, the assembly comprising:

a faceplate comprising:

an outer periphery;

an inner periphery defining an opening for fluid communication between the pool and the skimmer assembly; and means for securing the faceplate to a pool sidewall, wherein the inner periphery further comprises a male/female connector thereon; and a skimmer seal having an outer periphery including a female/male connector which sealingly engages the male/female connector on the inner periphery of the faceplate, whereby the pool skimmer assembly housing is not in fluid communication with the pool.

18. The assembly as recited in claim 17, wherein the inner periphery of the faceplate comprises an arm projecting generally toward an interior of the pool and having the male/female connector thereon.

19. The assembly as recited in claim 18, wherein the skimmer seal includes a C-shaped outer periphery which frictionally engages the arm, the C-shaped outer periphery including the female/male connector which sealingly engages the male/female connector on the inner periphery of the faceplate.

20. The assembly as recited in claim 17, wherein the skimmer seal includes a member extending from an outer periphery of the skimmer seal.

21. The assembly as recited in claim 20, wherein the member comprises a ring tab.

* * * * *